US005704730A

United States Patent [19]

Burton-Chambers

[11] Patent Number: 5,704,730

[45] Date of Patent: Jan. 6, 1998

[54] VEHICLE ARRESTING POST

[76] Inventor: Roderick Lloyd Burton-Chambers, The Beeches, Upper Bell Croft, Pinnar Lane, Southowram, Halifax, West Yorkshire HX3 9RJ, United Kingdom

[21] Appl. No.: 656,479

[22] Filed: May 31, 1996

Related U.S. Application Data

[63] Continuation of Ser. No. 443,924, May 18, 1995, abandoned.

[30] Foreign Application Priority Data

May 20, 1994 [GB] United Kingdom ..... 9410128

[51] Int. Cl.[6] ..... E01F 13/08

[52] U.S. Cl. ..... 404/6; 49/49; 49/131

[58] Field of Search ..... 404/6, 9, 10; 49/35, 49/49, 131; 187/203, 205, 207, 208, 218, 220; 414/678

[56] References Cited

U.S. PATENT DOCUMENTS

| | | | |
|---|---|---|---|
| 3,838,783 | 10/1974 | Tune | 187/208 X |
| 4,577,991 | 3/1986 | Rolow | 404/6 |
| 4,711,608 | 12/1987 | Ghusn | 404/6 |
| 4,762,439 | 8/1988 | Carlyle | 404/11 X |
| 5,248,215 | 9/1993 | Fladung | 404/6 |
| 5,441,359 | 8/1995 | Filippi | 404/6 |

*Primary Examiner*—James A. Lisehora
*Attorney, Agent, or Firm*—Thomas R. Vigil

[57] ABSTRACT

When a post 10 is hit by a car in the direction indicated by arrow 42 the post moves a restricted amount in the direction of that arrow and that movement causes a support member 34 to be lifted up to raise the front wheels of the car off the ground. A plate 58 is secured to the underside of the support member 34 and, during raising of the support member 34, the plate passes over a series of notches 56. However, the plate 58 abuts those notches 56 to prevent the support member 34 moving downwardly again.

16 Claims, 4 Drawing Sheets

VEHICLE ARRESTING POST

This is a continuation of application Ser. No. 08/443,924 filed May 18, 1995, now abandoned.

BACKGROUND OF THE INVENTION

The present invention relates to a post arrangement and a method of operating a post arrangement.

DESCRIPTION OF THE PRIOR ART

When security posts are in place it is common for these to be rammed by stolen cars. It often happens that a first car is used to repeatedly ram the post and remove the obstacle and then a second car, which has not been rendered unserviceable by the assault made on the post, is used to gain access to the area that the post was previously protecting. It is an object of the present invention to attempt to overcome at least some of the above described disadvantages.

SUMMARY OF THE INVENTION

According to one aspect of the present invention a post arrangement includes a post, a lifting portion, a link and latching device, the post being arranged to extend upwardly in an operative position; the lifting portion being arranged to be raised at a location spaced from the post in a first direction; the link connecting the post to the lifting portion by the link being pivotally connected to one of the post or lifting portion and slidably connected to the other of the post or lifting portion with the sliding movement of the link being restricted in at least one direction whereby, when the post is in the operative position and is subject to a significant impact from the first direction, the link connecting the post to the lifting portion causes the lifting portion to be raised with the latching device preventing the return of the raised lifting portion; the post, lifting portion and link being movable to a position in which the post assembly is substantially flush with the ground when the assembly is mounted in the ground.

The lifting portion may be arranged to lift a vehicle to prevent the vehicle from being used to ram the post again or to prevent the vehicle being removed with the post being rammed by another vehicle.

The post may be movable from a lower position to a raised position. The post may be pivotally movable between the lower and the raised positions.

The lifting portion may be pivotally movable when being raised. The post and the lifting portion may be pivotally movable about a common axis.

The post may be arranged to move when subject to a significant impact from the first direction. That movement of the post may be arranged to cause the lifting portion to be raised. The post may be arranged to abut the lifting portion when movement of the post causes raising of the lifting portion and that abutment may cause or assist in the raising of the lifting portion.

Movement of the post when the post is subject to a significant impact may be restricted, for instance by abutment.

The post may be adapted to be secured or locked in the raised position. Alternatively or additionally the post may be adapted to be secured or locked when in the lower position.

The lifting portion may require a force greater than a predetermined amount to be raised. The lifting portion may include an abutment constrained to move with the lifting portion that has to pass a stop that is restrained from moving with the lifting portion. The abutment may be detachably mounted on the lifting portion.

The latching means may comprise a lever pivotally connected to the lifting portion arranged to pass over an abutment when the lifting portion is being raised but to cooperate with the abutment to prevent return of the lifting portion from the raised position.

The post and the lifting portion may be arranged to be substantially flush with the ground when the assembly is mounted in the ground.

The post and the lifting portion or the post, the lifting portion and the latching means may be arranged to overlap each other in the horizontal direction when in a storage position.

The post arrangement may include a pair of posts each being associated with a different lifting portion whereby when one of the posts is subject to a significant impact from a first direction the lifting portion associated with that post is raised and when the other post is subject to a significant impact from an opposed direction the lifting portion associated with that other post is caused to be raised.

According to a further aspect of the present invention a method of operating a post arrangement comprises causing a lifting portion to be raised at a location spaced from a post in a first direction from the post when the post is subject to a significant impact from the first direction and preventing the return of the lifting portion, once raised.

The present invention also includes a method of operating a post arrangement as herein referred to.

The present invention includes any combination of the herein referred to features or limitations.

BRIEF DESCRIPTION OF THE DRAWINGS

The present invention may be carried into practice in various ways but one embodiment will now be described by way of example and with reference to the accompanying drawings in which.

DESCRIPTION OF THE PREFERRED EMBODIMENTS

Figure 1:
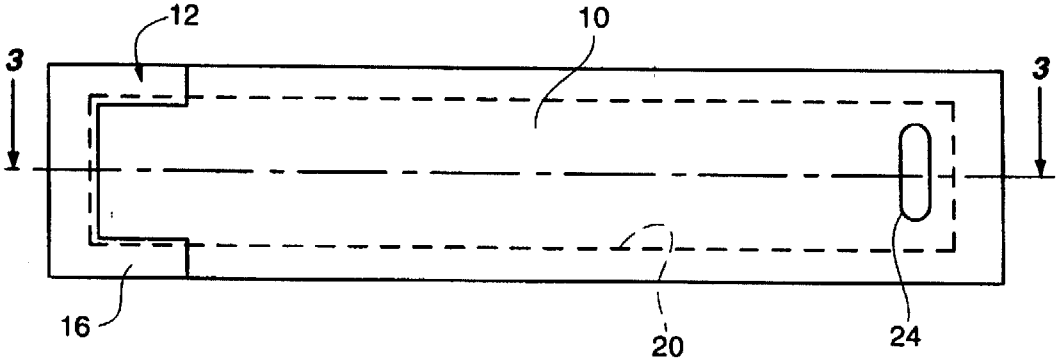
FIG. 1 is a schematic plan view of the post arrangement.
Figure 2:
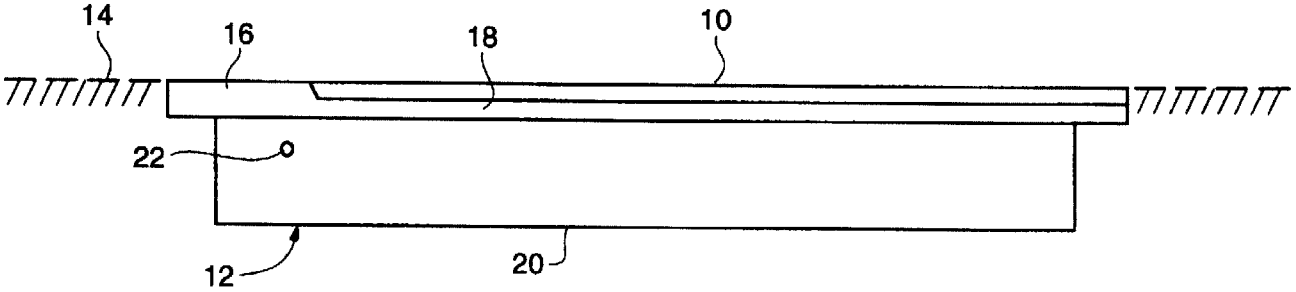
FIG. 2 is a side view of FIG. 1.
Figure 3:
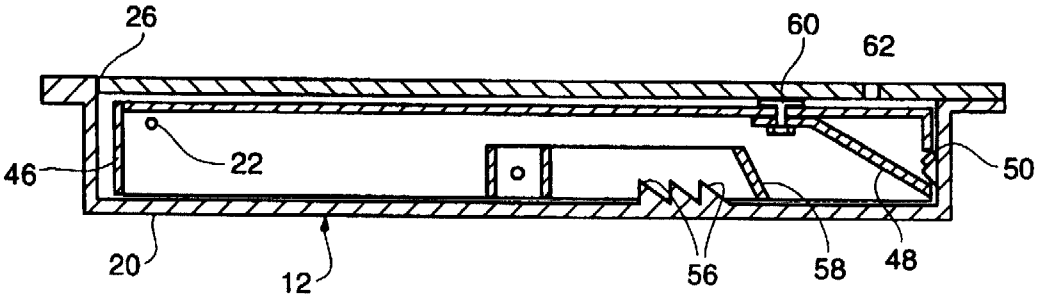
FIG. 3 is a longitudinal sectional view taken along the line III—III of FIG. 1.

As shown in FIGS. 1, 2 and 3 the post 10 is mounted in a housing 12 with the post 10 and the housing 12 being arranged to be flush with the ground 14.

The housing 12 includes a peripheral flange 16 with the flange being recessed as shown at 18 to accommodate the post. The housing 12 includes an elongate well 20 in which part of the post 10 and the remainder of the components are located. If desired, the housing can be secured to the ground by passing bolts through the lower wall of the well 20.

The post is connected to the housing by a pivot 22. In order to raise the post to the position shown in FIG. 4 an opening in the top of the post (when viewed in FIG. 1) provides a handle 24 remote from the pivot 22. By pulling the handle upwardly the post rotates about the pivot 22 until the post reaches the position shown in FIG. 4. In that position further anticlockwise movement of the post 10 about the pivot 22 is resisted by abutment of the post 10 with a support member, as described in more detail below. Return of the post 10 in a clockwise direction about the pivot 22 from the position shown in FIG. 4 can be prevented by passing the hasp of a padlock through an opening 28 formed in a flange 30 of the post and a strut 32. The strut 32 is connected to the support member 34 at a pivot 36. The other end of the strut 32 is connected to a bar 38 that, in the absence of the padlock, is able to slide along an elongate slot 40 formed in the flange 30. That sliding movement occurs when the post is raised to the position shown in FIG. 4. Although not shown in the drawings two parallel flanges 30 are provided each of which has a slot 40 and the bar 38 extends through both of those slots. In an alternative embodiment (not shown) the strut 32 is pivotally connected to one or both of the flanges 30 and is able to slide in a slot formed in the support member 34. In that instance the lock for the strut 32 can be provided by a yale lock mounted on the support member 34.

Figure 4:
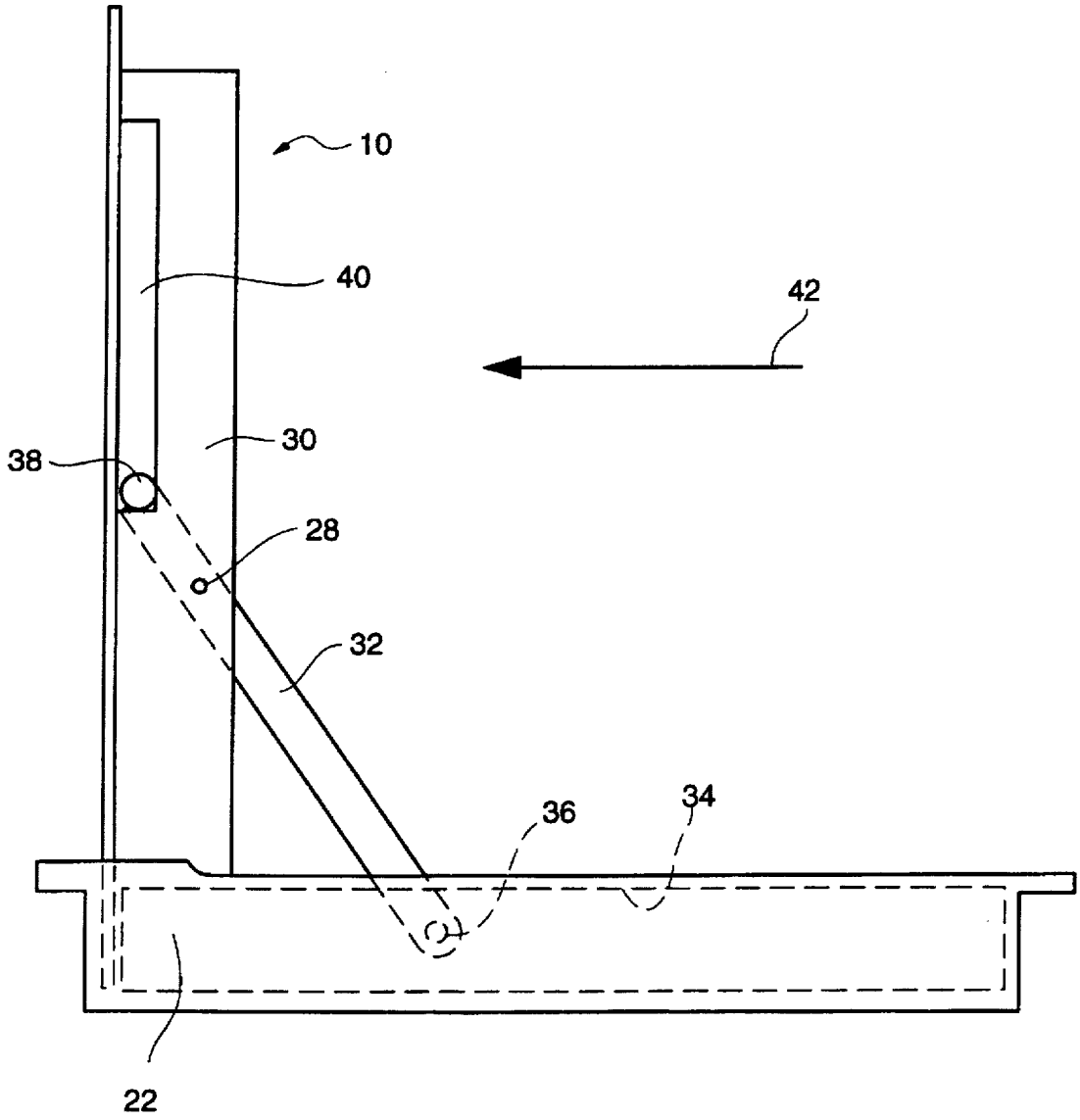
FIG. 4 is a side view showing the post 10 in the upright position.
Figure 5:
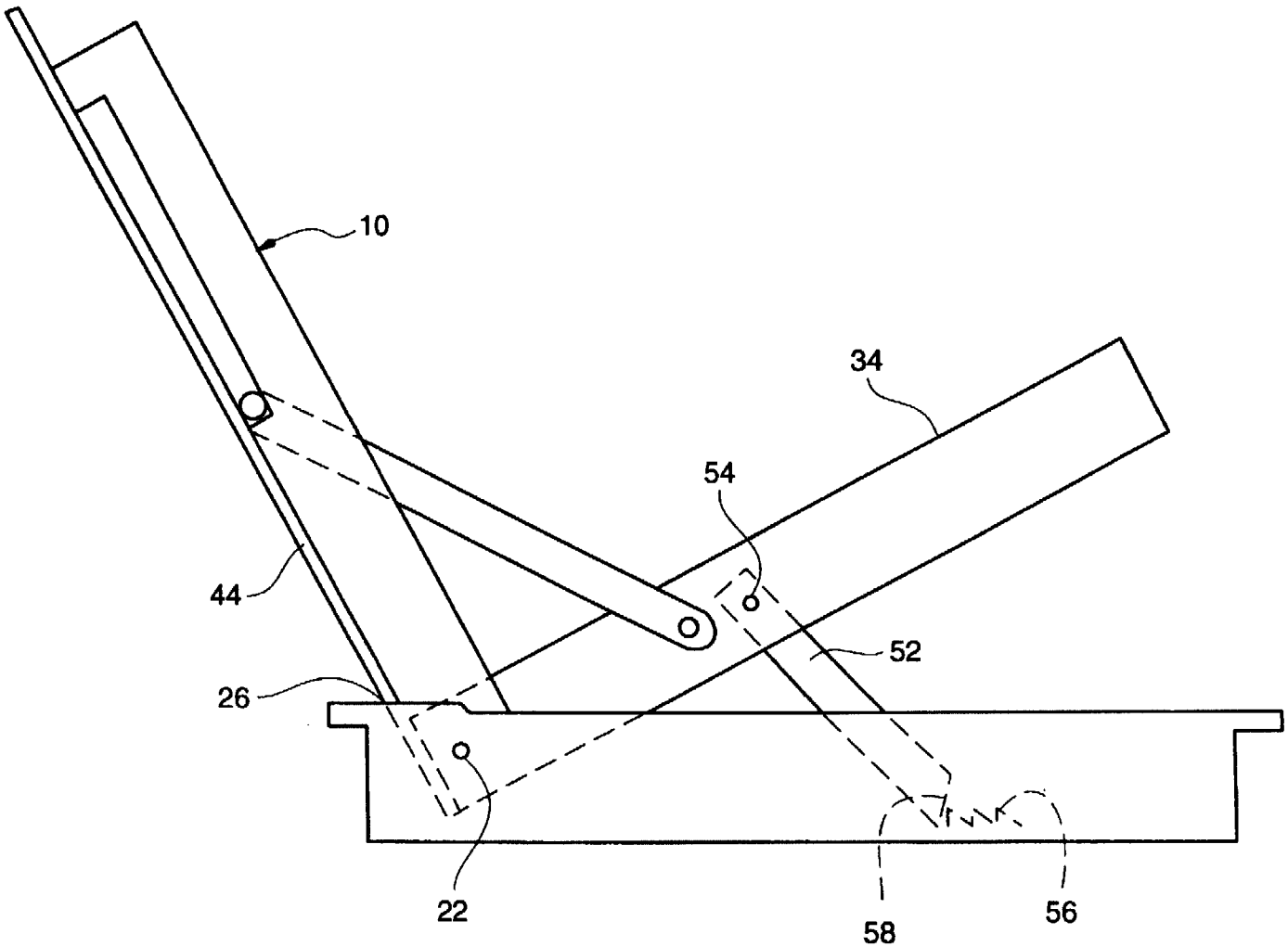
FIG. 5 is a view similar to FIG. 4 after the post has been rammed in a particular direction.

If the post 10 is hit by a car in the direction indicated by arrow 42 in FIG. 4 then the post moves to the position shown in FIG. 5 and the support member 34 will raise the front wheels of the vehicle off the ground. When the post 10 is hit the flat wall 44 of the post that connects the two flanges 30 of the post abuts the end wall 46 (shown in FIG. 3) of the support member 34 to exert an anticlockwise moment on the support member 34 about the pivot 22. Once the force exerted on the support member 34 is sufficient to cause a locking plate 48 to bend or flex over a notch 50 protruding into the well 20 from the housing the support member 34 is then able to move in an anticlockwise direction about the pivot 22. The strut 32 may assist in exerting the moment on the support member 34. Alternatively or additionally the strut 32 may exert some or the whole of the moment on the support member 34.

As the post 10 and the support member 34 move in an anticlockwise direction a lever 52 that is connected to the support member 34 at a pivot 54 is caused to move, at the pivot, upwardly and to the left when viewed in FIG. 5. The lower end of the lever 52 drags along the base of the well 20 and passes over a series of three notches 56 extending upwardly from the base of the well. When the weight of the vehicle is taken by the support member 34 at its upper end remote from the pivot 22 a substantial force is exerted on the member 34 to urge it in a clockwise direction about the pivot 22. As the support member 34 is moved downwardly from the position shown in FIG. 5 an angled plate 58 at the lower end of the strut 52 slides towards and abuts the notches 56 to prevent further downwards movement of the support member 34. Thus the car that has rammed the post is retained at the post as it has had its wheels raised off the ground and the post maintains the function of preventing the vehicle from passing it. In order to reactivate the post the vehicle has to be raised and removed from the lifting portion. When a vehicle is removed significant further anticlockwise movement of the post 10 about the pivot 22 is resisted by abutment of the wall 44 of the post with the edge 26 of the housing that leads from the flange 16 into the well 20.

Figure 6:
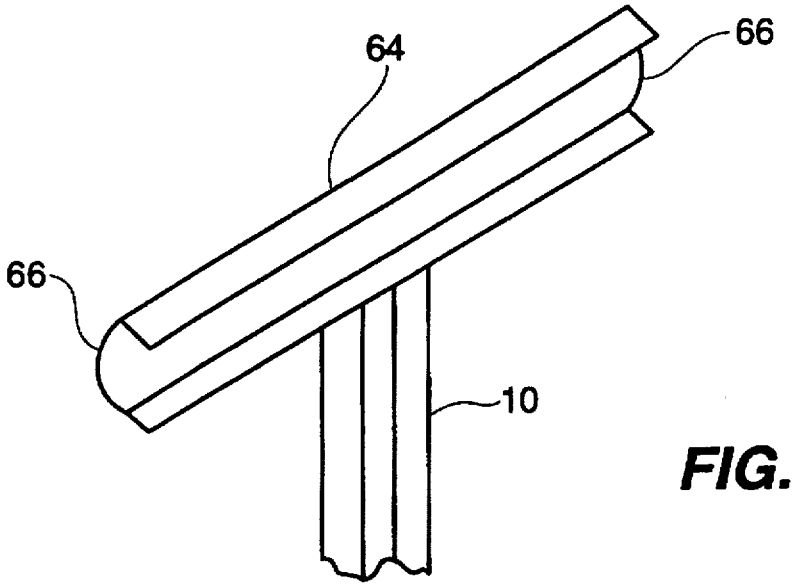
FIG. 6 is a schematic perspective view of the upper part of an alternative post.

FIG. 6 shows an alternative configuration for the top of the post 10. In this embodiment a cross bar 64 is welded to the top of the post 10. The cross bar is of a generally U cross-section, for strength and includes rounded ends 66. The wide post enables greater visibility of the post and ensures that a car will impact on the post to cause the support member 34 to be raised.

It will be appreciated that the shape of the well 20 will have to be modified to accommodate the cross bar 64. The end of the support member 34 remote from its pivot 36 also includes a cross bar corresponding to the profile of the cross bar 64 that normally sits within the well. When the post is impacted the cross bar of the support member will be raised. The increased width of the cross bar compared to that of the support member will ensure that the underside of a vehicle will be contacted at a lifting place of the vehicle and will reduce the risk of the support member without that bar unfortunately being lifted into a gap in the underside of the vehicle thereby failing to lift the vehicle either at all or sufficiently.

The locking plate 48, if it is damaged upon the post being rammed, can be removed by detaching the nut and bolt 60 and replaced by a new plate 48. Alternatively, if the plate 48 is merely flexed upon disengagement then the nut and bolt can be slackened, the plate 48 and the nut and bolt can be slid rearwardly in a slot 62 provided in the support member before the plate 48 is slid forward again to be located beneath the lug 50. The nut and bolt 60 are then tightened to again retain the locking plate in position.

The post 10 can be locked in the position shown in FIGS. 1 to 3 by having a lock extending from the post 10 to a cooperating portion of the support member 34.

Figure 7:
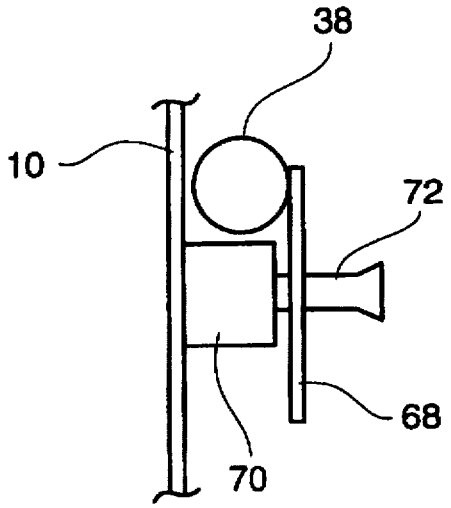
FIGS. 7 and 8 are schematic side sectional views showing alternative embodiments for locking the post in the upright position.
Figure 8:
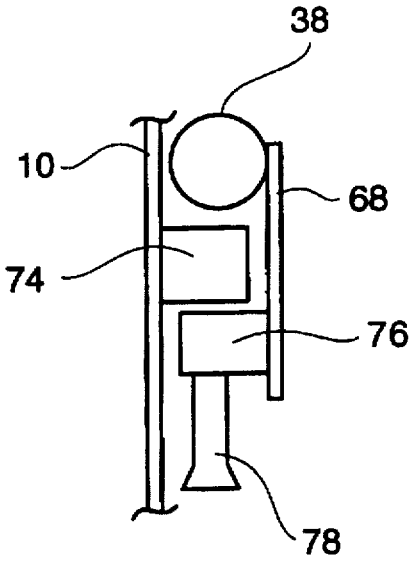

Alternative methods for locking the post in the upright position are shown in FIGS. 7 and 8.

In FIG. 7 the bar 38 includes a downwardly extending plate 68. That plate overlaps and obscures an internally threaded cylinder 70 that is welded to the post. A bolt 72 can be passed through an opening in the plate 68 and screwed into the threaded cylinder 70 to clamp the two parts together.

In FIG. 8 two internally threaded cylinders are provided with the upper cylinder 74 being welded to the post and the lower cylinder 76 being welded to the plate 68. When the post is in the upright position a bolt 78 is screwed upwardly through the aligned cylinders to hold the parts together.

The bolts 72 and 78 are security bolts that require a specially modified head of a tool in order to engage and turn the bolts satisfactorily.

In a further alternative embodiment (not shown) two posts can be mounted in a single base with each of the posts being raisable towards each other to the position shown in FIG. 4 with the flat walls 44 facing each other. In that position the posts may be spaced from each other to allow for each post to be able to take up the configuration shown in FIG. 5 without the posts abutting each other. In this way the post arrangement is able to resist ramming in both directions.

What I claim is:

1. A post arrangement including a post, a lifting portion, a link and latching means, said post being arranged to extend upwardly in an operative position; said lifting portion being arranged to be raised at a location spaced from said post in a first direction; said link connecting said post to said lifting portion by said link being pivotally connected to one of the post and lifting portion and slidably connected to the other of said post and lifting portion with said sliding movement of said link being restricted in at least one direction whereby, when said post is in the operative position and is subject to a significant impact from said first direction, said link connecting said post to said lifting portion causes said lifting portion to be raised with said latching means preventing the return of the raised lifting portion; said post, lifting portion and link being movable to a position in which the post assembly is substantially flush with the ground when the assembly is mounted in the ground.

2. An arrangement according to claim 1 in which the lifting portion is arranged, in use, to lift a vehicle that has subjected the post to a significant impact from the first direction.

3. An arrangement according to claim 1 including a pivot, said post being pivotally movable around said pivot between the position in which the post assembly is substantially flush with the ground and the operative position.

4. An arrangement according to claim 1 including a pivot, said lifting portion being pivotally movable about said pivot when being raised.

5. An arrangement according to claim 4 in which the post and the lifting portion are pivotally movable about a common axis.

6. An arrangement according to claim 1 in which the post is arranged to abut the lifting portion when movement of the post causes raising of the lifting portion.

7. An arrangement according to claim 6 in which the abutment of the post with the lifting portion is arranged to cause or assist in the raising of the lifting portion.

8. An arrangement according to claim 1 in which movement of the post when the post is subject to a significant impact is restricted.

9. A post as claimed according to claim 1 including locking means which is adapted to secure or lock the post in the operative position.

10. An arrangement according to claim 1 in which the lifting portion requires a force greater than a predetermined amount to be raised.

11. An arrangement according to claim 10 in which the lifting portion includes an abutment and a stop, said abutment being constrained to move with the lifting portion that has to pass said stop that is restrained from moving with the lifting portion.

12. An arrangement according to claim 11 in which the abutment is detachably mounted on the lifting portion.

13. An arrangement according to claim 1 in which the latching means comprise a lever and an abutment, said lever being pivotally connected to the lifting portion and being arranged to pass over said abutment when the lifting portion is being raised with said lever being arranged to cooperate with that abutment to prevent return of the lifting portion from the raised position.

14. An arrangement according to claim 1 in which the post, the lifting portion and the latching means are arranged to overlap each other in a horizontal direction when in a storage position.

15. An arrangement according to claim 1 in which the post and the lifting portion are arranged to overlap each other in a horizontal direction when in a storage position.

16. A post lay out including a pair of post arrangements each according to claim 1 with each of the posts being associated with a different lifting portion whereby when the posts are in the operative position, then one of the posts is subject to a significant impact from the first direction the lifting portion associated with that post is raised and when the other post is subject to a significant impact form an opposed direction the lifting portion associated with that other post is caused to be raised.

* * * * *